US009089730B2

(12) United States Patent
Shalev et al.

(10) Patent No.: US 9,089,730 B2
(45) Date of Patent: Jul. 28, 2015

(54) BIODEGRADABLE FIRE-FIGHTING FORMULATION

(75) Inventors: Itzhak Shalev, Beit Gamliel (IL); Mircea Bucevschi, Rehovot (IL); Monica Colt, Rehovot (IL)

(73) Assignee: ZZAKEY TECHNOLOGIES LTD, Beit Gamliel (IL)

( * ) Notice: Subject to any disclaimer, the term of this patent is extended or adjusted under 35 U.S.C. 154(b) by 0 days.

(21) Appl. No.: 13/988,691

(22) PCT Filed: Nov. 25, 2011

(86) PCT No.: PCT/US2011/062153

§ 371 (c)(1), (2), (4) Date: May 21, 2013

(87) PCT Pub. No.: WO2012/071577

PCT Pub. Date: May 31, 2012

(65) Prior Publication Data

US 2013/0264509 A1 Oct. 10, 2013

Related U.S. Application Data

(60) Provisional application No. 61/417,227, filed on Nov. 25, 2010.

(51) Int. Cl.
*A62D 1/00* (2006.01)

(52) U.S. Cl.
CPC ..... *A62D 1/0064* (2013.01); *A62D 1/005* (2013.01)

(58) Field of Classification Search
None
See application file for complete search history.

(56) References Cited

U.S. PATENT DOCUMENTS

| | | | | | |
|---|---|---|---|---|---|
| 3,345,289 | A | * | 10/1967 | Freifeld et al. | 252/609 |
| 3,758,641 | A | * | 9/1973 | Zweigle | 525/186 |
| 3,956,138 | A | * | 5/1976 | Crockett | 252/3 |
| 3,984,334 | A | * | 10/1976 | Hopper | 252/8.05 |
| 4,037,665 | A | * | 7/1977 | Hopper | 169/49 |
| 4,226,727 | A | * | 10/1980 | Tarpley et al. | 252/8 |
| 4,234,432 | A | * | 11/1980 | Tarpley, Jr. | 252/8 |
| 4,836,939 | A | | 6/1989 | Hendrickson | |
| 4,871,728 | A | * | 10/1989 | Sebestyen et al. | 514/187 |

(Continued)

OTHER PUBLICATIONS

Amass. W, Amass A., Tighe B. , "A Review of Biodegradable Polymers: Uses, Current Developments in the Synthesis and Characterization of Biodegradable Polyesters, Blends of Biodegradable Polymers and Recent Advances in Biodegradation Studies", Polymer International, 1998, pp. 89-144, vol. 47, Society of Chemical Industry, UK.

(Continued)

*Primary Examiner* — Joseph D Anthony
(74) *Attorney, Agent, or Firm* — Daniel Feigelson; Fourth Dimension IP

(57) ABSTRACT

This invention relates to a formulation material and its method useful in forestry firefighting, the formulation material comprising: (a) an anhydride copolymer having a structural formula wherein a functional group X of said formula is at least one alkyl group selected from the family consisting of methyl, ethyl, and propyl groups! and (b) at least 0.1%, by weight, of at least one cross-linking agent for said anhydride copolymer, said agent selected from the group of cross-linking agents consisting of a biopolymer and a tannin, wherein a weight ratio of said anhydride copolymer to said cross-linking agent is at least 2:1, and wherein a total weight of said anhydride copolymer and said cross-linking agent, within the formulation, is at least 25% on an anhydrous basis.

22 Claims, 7 Drawing Sheets

(56) References Cited

U.S. PATENT DOCUMENTS

| | | | | | |
|---|---|---|---|---|---|
| 4,978,460 | A | * | 12/1990 | Von Blucher et al. | 252/2 |
| 5,190,110 | A | * | 3/1993 | von Blucher et al. | 169/46 |
| 5,332,524 | A | * | 7/1994 | Kaylor | 252/363.5 |
| 5,422,330 | A | * | 6/1995 | Kaylor | 502/402 |
| 5,496,475 | A | | 3/1996 | Jho et al. | |
| 5,518,638 | A | * | 5/1996 | Buil et al. | 252/2 |
| 5,849,210 | A | * | 12/1998 | Pascente et al. | 252/3 |
| 5,861,106 | A | * | 1/1999 | Olander | 252/7 |
| 5,985,284 | A | * | 11/1999 | Lowell | 424/234.1 |
| 5,989,446 | A | * | 11/1999 | Hicks et al. | 252/8.05 |
| 5,997,758 | A | * | 12/1999 | Barbarin et al. | 252/3 |
| 6,019,176 | A | * | 2/2000 | Crouch | 169/46 |
| 6,245,252 | B1 | * | 6/2001 | Hicks et al. | 252/8.05 |
| 6,296,781 | B1 | * | 10/2001 | Amiran | 252/8.05 |
| 6,322,726 | B1 | * | 11/2001 | Vandersall et al. | 252/601 |
| 7,033,526 | B2 | * | 4/2006 | Figiel et al. | 252/601 |
| 7,189,337 | B2 | * | 3/2007 | Sortwell | 252/8.05 |
| 7,189,843 | B2 | * | 3/2007 | Tsai et al. | 536/114 |
| 7,365,190 | B2 | | 4/2008 | Couture et al. | |
| 7,670,513 | B2 | * | 3/2010 | Erdner et al. | 252/610 |
| 2009/0212251 | A1 | | 8/2009 | Taylor | |

OTHER PUBLICATIONS

Chitanu G. C., Rinaudo M., Milas M., Carpov A. , "Thermal Stability of Maleic Acid-Vinyl Acetate Copolymer in Aqueous Solution: Size Exclusion Chromatography Analysis", International Journal of Polymer Analysis and Characterization, 2005, pp. 123-139, vol. 10, Taylor & Francis LLC, Florence, KY, USA.

Ladaviere C., Delair T., Domard A., Pichot C., Mandrand B., "Studies of the thermal stability of maleic anhydride co-polymers in aqueous solution", Polymer Degradation and Stability, 1999, pp. 231-241, vol. 65, Elsevier, MA, USA.

Olabisi O., Robson L.M., Shaw M.T., "Polymer-Polymer Miscibility", 1979 , Academic Press, New York , NY, USA., pp. 1-19.

Swift G., "Biodegradation of Synthetic Water Soluble Polymers" , Biopolymers, 2002, vol. 9, Wiley—VCH Verlag GmbH, Weinheim, Germany, pp. 237-266.

* cited by examiner

Figure 4a
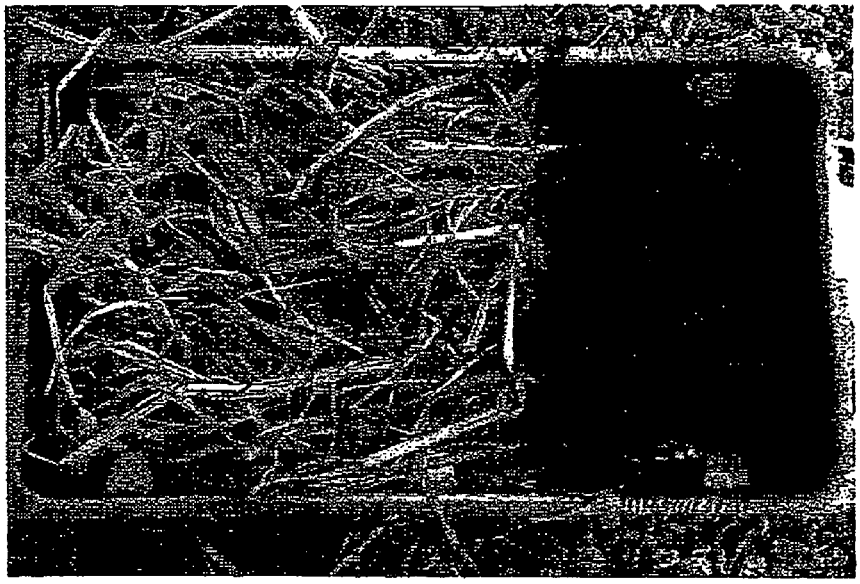
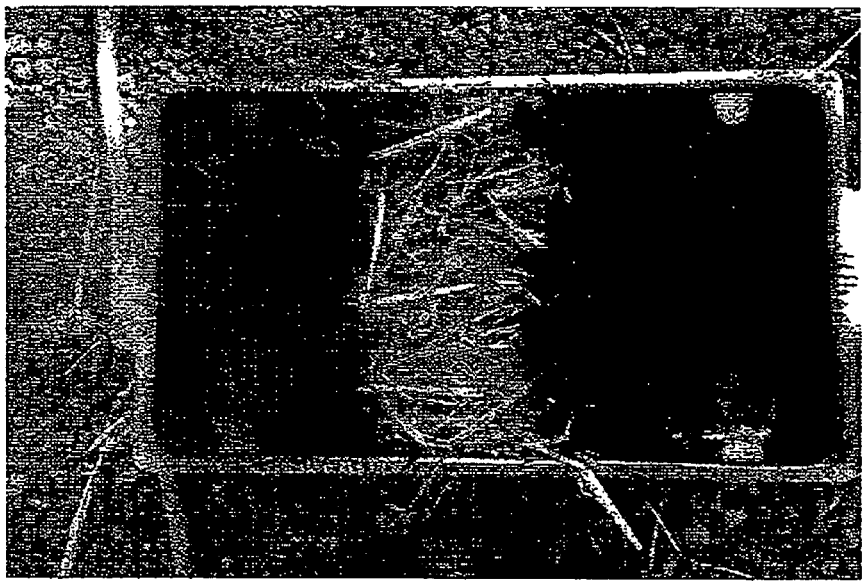
Figure 4b

BIODEGRADABLE FIRE-FIGHTING FORMULATION

CROSS-REFERENCE TO RELATED APPLICATIONS

This application is a 35 U.S.C. §371 application of PCT/US2011/062153, filed Nov. 25, 2011 and entitled "BIODEGRADABLE FIRE-FIGHTING FORMULATION", and claims the benefit of U.S. Provisional Patent Application Ser. No. 61/417,227, filed Nov. 25, 2010, having the same title, which provisional application is incorporated by reference for all purposes as if fully set forth herein

FIELD OF THE INVENTION

The invention, in at least some aspects, relates to the field of fire-fighting formulations and methods, and more particularly, to ambiently degradable formulations and methods for fighting fires, particularly forest fires.

BACKGROUND OF THE INVENTION

Fire is the rapid oxidation of a material in the chemical process of combustion, releasing heat, light, and various reaction products. Fires start when a flammable and/or a combustible material, in combination with a sufficient quantity of an oxidizer such as oxygen gas or another oxygen-rich compound, is exposed to a source of heat or ambient temperature above the flash point for the fuel/oxidizer mix, and is able to sustain a rate of rapid oxidation that produces a chain reaction.

Forest fires are uncontrolled fires occurring in combustible vegetation. A forest fire differ from other fires by its extensive size, the speed at which it can spread from its original source, its potential to change direction unexpectedly, and its ability to jump gaps such as roads and rivers.

Water is currently the most frequently used fire-fighting medium. The extinguishing properties of water are based mainly on its effect in cooling the combustible material to a temperature below the ignition point of the material, by absorbing heat through conversion of water to water vapor.

Use of water as an extinguishing agent has a number of disadvantages. For example, during the extinguishing process, large quantities evaporate or flow away unused and may cause unnecessary water damage.

Use of water is particularly disadvantageous in fighting forest fires, because such fires are frequently preceded by a period of drought, and, accordingly, the ground has a particularly high water absorptive capacity. The waste of water is a very important aspect of forest fire fighting because a forest fire typically consumes the dry undergrowth (e.g., grass, foliage, and heather) and leads to individual crown fires which then unite.

Furthermore, since most forest fires occur in remote areas, aircraft are often employed. Fighting forest fires with aircraft involves the dropping of large quantities of water on the fire. However, by this method, as much as 80% of the load is wasted due to erosion before reaching the target, such that the aircraft must make a considerable number of trips in order to get the required amount of water on the fire to cool the vegetation to below its ignition point.

Numerous attempts have been made to improve water as a fire extinguishing agent. Thus, for example, the addition of substances which increase the viscosity of water have been described. These include cellulose derivatives, alginates or water-soluble synthetic polymers, such as polyacrylamides.

Use has also been made of non-flammable mineral additives to the extinguishing water, e.g. water-soluble inorganic salts or water-insoluble materials such as bentonite or attapulgite [C. E. Hardy, Chemicals for Forest Fire Fighting, 3rd edition, Boston, 1977].

In special cases, such as when fighting forest fires, use has been made of mineral additives such as bentonite, attapulgite and water-soluble salts, as well as extinguishing water formulations mixed with alginates, which, after special preparation are frequently ejected from aircraft. Disadvantages associated with use of such additives include the high weight percentages of mineral additives generally required in order to achieve a sufficiently high level of thickening (e.g. 10 to 20% by weight); the corrosive action of certain salts such as sulfates or chlorides; and the possibility of undesired environmental influences, such as on fertilizing agents. Furthermore, the preparation of such thickened extinguishing agents generally requires special apparatus, particularly with respect to the mixing process. These agents generally cannot be applied using conventional fire extinguishing syringes and, such as in the case of alginate gums, do not adhere well to the target surfaces following spraying, particularly under the action of heat. Additionally, they frequently change their characteristics after even a short storage period and, after drying, sometimes leaving behind residues which are difficult to remove.

Other fire-fighting compositions are known in the art, which are aimed at either decreasing water consumption or prevention of re-ignition of fire, or both.

For example, suspensions for use in fire-fighting are known, comprising insoluble particles dispersed in a water-soluble polymer solution. Two types of such suspension are known: solid-liquid suspensions and gel-liquid suspensions.

Solid-liquid suspensions are described, for example, in U.S. Pat. Nos. 3,984,334; 4,037,665; 4,226,727; 4,234,432; and 5,861,106.

U.S. Pat. No. 4,652,383 describes a solid-liquid suspension composition comprising solid particles of vinyl polymer gelling agent (preferably a polyacrylate) and an ammonium compound suspended in a gelled liquid. Such a composition is not suitable for application using aerial equipment, and the polyacrylates are non-biodegradable materials.

U.S. Pat. Nos. 5,332,524 and 5,422,330 describe a fire-extinguishing solid-liquid suspension comprising water soluble poly(ethylene oxide) polymer for extinguishing Class A fire, and in association with fluoro-surfactant for extinguishing Class B fire. The composition is applied as a foam. The flow properties of the composition, the application mode and efficacy of extinguishing action are not disclosed.

U.S. Pat. No. 5,518,638 describes the use of thickened synthetic amorphous silica in water as a fire extinguishing and protection agent, using water-soluble polymers such as polyethylene glycols, polypropylene glycols, and their derivatives as thickening agent.

U.S. Pat. Nos. 4,971,728; 6,322,726; and 6,019,176 disclose chemical concentrates adapted for dilution with water to produce long term fire suppressants specially adapted for aerial application to suppress wild land fires, using guar gum and its derivatives as thickeners and flow conditioners. Disadvantages of these compositions include the fact that the polysaccharides used are very expensive, and the preparation of the aqueous solutions is difficult, requiring specialized equipment.

Gel-liquid compositions include those in which the gel phase comprises cross-linked synthetic polymers, known as super absorbent polymers (SAPs). Gels function as short-term fire retardants, since their effectiveness is due to their water content, such that upon evaporation of all the water, the gels are no longer effective.

U.S. Pat. No. 3,758,641, describes the use of a water-swellable, water-insoluble polymer gel comprising a crosslinked polymer or crosslinked copolymer of acrylamide, an acrylate salt, vinyloxazolidinone, vinylpyrrolidinone, a methacrylate salt, or a styrenesulfonate salt, or a copolymer of styrene and maleic acid, which has been crosslinked by reaction with a glycol. The crosslinked gel is mixed with a water-soluble synthetic cationic polymer in order to promote adhesion to cellulosic material. The application mode of the composition is not specified.

U.S. Pat. No. 4,978,460 describes the use of solid polymer particles of polyacrylate gel encased in a water-soluble release agent to extinguish fires. The time taken for these solid granular particles to expand upon absorption of water is longer than practical for the water to be retained in a fire hose. Additionally, in order to achieve the desired water absorption, 200 grams of gel per liter of water is required.

U.S. Pat. No. 5,190,110 describes absorbent polymers comprising discrete particles of insoluble sodium polyacrylate dispersed in a water miscible medium to be incorporated into water.

U.S. Pat. No. 5,849,210 describe a method of preventing a combustible object from burning by contacting the combustible object, before or during burning, with an aqueous composition comprising a water-insoluble superabsorbent polymer (SAP) and water.

The above prior art gel-liquid compositions are not suitable for use against forest fires, since the compositions must be washed away after use, are not biodegradable, and do not prevent re-ignition of the fire after water evaporation.

Another problem encountered in fighting a forest fire is an inability to precisely determine which objects, or areas, have been sprayed and which have not. This is an especially difficult problem encountered in aerial fighting of forest fires. Effective fire fighting requires that all objects or areas of interest are sprayed, while minimizing double spraying of some objects or areas.

U.S. Pat. No. 7,670,513 discloses a fire-fighting composition comprising a superabsorbent polymer (polyacrylate sodium salt); a soluble or dispersible colorant; an additional opacifying agent; and water. The colorant is selected such that its color is in contrast to the color of the combustible objects being treated.

Due to the solid, granular nature of the absorbent polymer particles used in prior art firefighting compositions, it is difficult, if not impossible, to use these polymers in certain applications. For example, if a natural source of water, such as a creek or a river, is to be used as the water source, it is impossible to pre-mix the polymer and batch add it to the water source, as necessary in traditional applications, in order to draw it off to use to combat fires. By pouring the additive into a stream or river, most of the additive will simply flow past the point of suction of the water for use in combating fires.

Likewise, because of the particulate nature of the known water-absorbent polymers used in firefighting compositions, use of such polymers in standard firefighting hoses with standard equipment is nearly impossible. The solid nature of the polymers promotes particle agglomeration and subsequent blockage of the flow of the water. Alternatively, it is also sometimes necessary to provide pumps and spray nozzles adapted for handling such solid granular particles (see, for example, U.S. Pat. No. 3,758,641).

Some of the disadvantages associated with use of SAP in gel-liquid firefighting compositions can be overcome by the use of emulsions.

U.S. Pat. No. 6,296,781 discloses a fire extinguishing emulsion containing emollient; emulsifier; dispersant; oxygen depleting substance; radical scavenger; and oxygen competitor, in water acting as a carrier.

U.S. Pat. Nos. 5,989,446 and 6,245,252 disclose a water additive containing a cross-linked, water-swellable polymer additive in a water/oil emulsion produced by an inverse phase polymerization reaction to be added to the firefighting water. The polymer is a co-polymer of acrylamide and acrylic acid derivatives.

We have observed that such formulations may include chemical combinations that are dangerous to plants, and that various compounds disposed in the formulations may be substantially non-degradable or insufficiently degradable, particularly at ambient conditions.

We have further observed that the formulations do not contain a long term flame retardant, such that the underlying vegetation may be disadvantageously re-ignited after the water is evaporated.

U.S. Pat. No. 7,033,526 describes a firefighting composition in the form of a gel containing urea or a urea derivative that retains water and releases $CO_2$ upon heating. The composition also includes a rheology modifier. Disadvantages of these compositions are similar to those of the above-described emulsions.

U.S. Pat. No. 7,189,337 describes a fire-fighting additive having a cross-linked, water-swellable polymer and a vegetable oil dispersion. The additive is added to firefighting water to form a gel. The use of such an additive may have the same disadvantages as the use of various traditional synthetic polymers.

The inventors have perceived a need for further improvements in fire-fighting formulations and methods, and the subject matter of the present disclosure and claims is aimed at fulfilling this need.

SUMMARY OF THE INVENTION

Some embodiments of the invention relate to ambiently degradable aqueous formulations for use in fighting fires, particularly forest and brush fires. According to teachings of the present invention, the formulation may include: (a) an anhydride copolymer having a structural formula of:

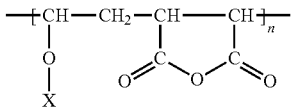

wherein a functional group X of said formula is at least one alkyl group selected from the family consisting of methyl ($CH_3$), ethyl ($C_2H_5$), and propyl ($C_3H_7$) groups; and (b) at least 0.1%, by weight, of at least one cross-linking agent for said anhydride copolymer, said agent selected from the group of cross-linking agents consisting of a biopolymer and a tannin, wherein a weight ratio of said anhydride copolymer to said cross-linking agent is at least 2:1, and wherein a total weight of said anhydride copolymer and said cross-linking agent, within the formulation, is at least 25% on an anhydrous basis.

According to further features in the described preferred embodiments, the total weight of said anhydride copolymer and said cross-linking agent, within the formulation, is at least 30%, at least 40%, at least 50%, at least 60%, or at least 75%, on an anhydrous basis.

According to still further features in the described preferred embodiments, a ratio of said first monomer to said second monomer (M1:M2) in said synthetic anhydride copolymer is about 50:50 mole percent.

According to still further features in the described preferred embodiments, the molecular weight of said synthetic anhydride copolymer is greater than about 50,000 Da.

According to still further features in the described preferred embodiments, the formulation further comprises at least one long-term fire retardant.

According to still further features in the described preferred embodiments, the at least one long-term flame retardant is selected from the group consisting of brominated compounds, phosphorous compounds, organophosphorous compounds, chlorinated compounds, tin compounds, alumina hydrates, metal polyphosphates, borates and antimony oxides.

According to still further features in the described preferred embodiments, the at least one long-term flame retardant is selected from the group consisting of penta-bromodiphenyl ether, octa-bromodiphenyl ether, decabromodiphenyl ether, short-chain chlorinated paraffins (SCCPs), medium-chain chlorinated paraffins (MCCPs), hexabromocyclododecane (HBCD), tetrabromobisphenol A (TBBPA), pentabromotoluene, 2,3-dibromopropyl-2,4,6-tribromophenyl ether, tetrabromobisphenol A, bis(2,3-dibromopropyl ether), tris(tribromophenoxy)triazine, tris(2-chloroethyl)phosphate (TCEP), tris(2-chloro-1-methylethyl) phosphate (TCPP or TMCP), tris (1,2-dichloropropyl) phosphate (TDCP), 2,2-bis(chloromethyl)-trimethylene bis (bis(2-chloroethyl)phosphate), melamine cyanurate, antimony trioxide $Sb_2O_3$ (ATO), boric acid, ammonium polyphosphate (APP), aluminum ammonium polyphosphate, aluminum hydroxide, magnesium hydroxide and red phosphorous.

According to still further features in the described preferred embodiments, the long-term flame retardant is an inorganic polyphosphate or a metal-containing polyphosphate such as an aluminum containing polyphosphate.

According to still further features in the described preferred embodiments, the concentration of said long-term flame retardant within the formulation, is in a range of from 6% to 16%, by weight, on said anhydrous basis.

According to still further features in the described preferred embodiments, the long-term flame retardant is substantially insoluble in water and at most practically insoluble in water at ambient conditions.

According to still further features in the described preferred embodiments, the cross-linking agent includes a tannin.

According to still further features in the described preferred embodiments, the tannin is selected from the group consisting of a gallotannin and a flavotannin.

The gallotannin may be selected from, but is not limited to, the group consisting of Chinese tannin; Turkish tannin; hamamelis tannin; acertannin; glucogallin; sumac tannin; Valonia oak gall tannin; tea tannin; tara tannin; myrabolam tannin; Divi-Divi tannin; Algarobillo tannin; oak tannin; and chestnut tannin.

The flavotannin may be selected from, but is not limited to, the group consisting of Gambier, Catechu, or Burma Cutch; Quebracho; Tizerah; Urunday; wattle, mangrove; spruce; hemlock; larch; willow; and Avaram tannins.

According to still further features in the described preferred embodiments, the concentration of said tannin is in a range of 1% to 8%, by weight, on said anhydrous basis.

According to still further features in the described preferred embodiments, the cross-linking agent includes both said biopolymer and said tannin.

According to still further features in the described preferred embodiments, the biopolymer is at least one water-soluble biopolymer selected from the group consisting of a polysaccharide and a protein.

According to still further features in the described preferred embodiments, the polysaccharide may be selected from, but is not limited to, the group consisting of starch, dextran, pullulan, gellan gum, xylan, carrageenan, agar, locust bean gum, guar gum, gum arabic, pectin, alginate, chitosan, xanthan, methylcellulose, ethylcellulose, hydroxyethylcellulose, hydroxypropylcellulose, ethylhydroxyethylcellulose, hydroxybutylmethylcellulose, hydroxyethylmethylcellulose, hydroxyethyl starch, hydroxypropyl starch, carboxymethylcellulose, and carboxymethyl starch.

According to still further features in the described preferred embodiments, the viscosity of a 1% solution of said guar gum is preferably in the range of 500 to 3,000 cps; the viscosity of a 1% solution of said alginate is preferably in the range of 500 to 700 cps.

According to still further features in the described preferred embodiments, the protein may be selected from, but is not limited to, the group consisting of gelatin, collagen hydrolysate, keratin hydrolysate, actin, osteocalcin, myosin, casein, albumin, soybean protein, rubisco, derivatives thereof and mixtures thereof.

According to still further features in the described preferred embodiments, the protein may include gelatin having a Bloom Index in the range of from about 20 to about 500, and has an isoelectric pH point in the range of from about 3.5 to about 9.5.

According to still further features in the described preferred embodiments, the concentration of said biopolymer is in a range of about 1% to about 12%, by weight, on an anhydrous basis.

According to still further features in the described preferred embodiments, the total weight (%) of said anhydride copolymer and said cross-linking agent, within the formulation, is at least 6%, at least 8%, at least 10%, at least 12%, at least 15%, or at least 20%, on a hydrated basis.

According to still further features in the described preferred embodiments, the concentration of clay within the formulation is below 5%, below 4%, below 3%, below 2%, below 1%, or below 0.5%, by weight, on an anhydrous basis. The formulation is typically free or substantially free of clay.

According to still further features in the described preferred embodiments, the concentration of water-soluble potassium within the formulation is below 5%, below 4%, below 3%, below 2%, below 1%, or below 0.5%, by weight, on an anhydrous basis.

According to still further features in the described preferred embodiments, the concentration of water-soluble sodium within the formulation is below 3%, below 2%, below 1%, or below 0.5%, by weight, on said anhydrous basis. The formulation may be substantially free of water-soluble sodium.

According to another aspect of the present invention there is provided a method of preparing an ambiently degradable aqueous gel formulation useful in forestry firefighting, the method comprising the steps of: (a) providing an anhydride copolymer, water, and at least one cross-linking agent for said anhydride copolymer, said agent selected from the group of cross-linking agents consisting of a biopolymer, a tannin, and a bivalent cation; (b) reacting said copolymer and said cross-linking agent with an inorganic alkaline compound, in a presence of said water, to produce the ambiently degradable aqueous gel formulation.

According to further features in the described preferred embodiments, the method further comprises the step of introducing, to the formulation, at least one long-term fire retardant, preferably including a chemical anti-smoldering mechanism.

According to still further features in the described preferred embodiments, at least two of said biopolymer, said tannin, and said bivalent cation are cross-linked to said anhydride copolymer.

According to still further features in the described preferred embodiments, the inorganic alkaline compound is selected from the group consisting of at least one of a hydroxide, bicarbonate, and carbonate of an alkaline metal, an alkaline earth metal, and ammonium hydroxide.

According to still further features in the described preferred embodiments, the inorganic alkaline compound is selected from the group consisting of sodium hydroxide, potassium hydroxide, ammonium hydroxide, calcium hydroxide, sodium carbonate, potassium carbonate, sodium bicarbonate, potassium bicarbonate, calcium carbonate, calcium bicarbonate, barium hydroxide, magnesium hydroxide and mixtures thereof.

According to another aspect of the present invention there is provided an ambiently degradable aqueous gel formulation comprising: (a) water; and (b) a water-absorbent, ambiently degradable polymer matrix having (i) a first repeating, ambiently degradable base structure represented by:

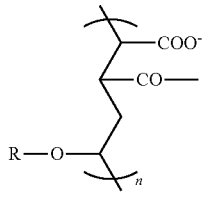

and having a carboxyl ion moiety (—COO—) and a first carbonyl moiety (—CO—); (ii) a second repeating, ambiently degradable base structure represented by:

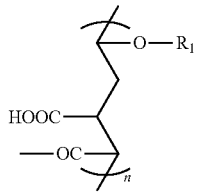

having a carboxyl moiety (—COOH) and a second carbonyl moiety (—CO—); wherein functional groups R and $R_1$ in said base structures are alkyl groups selected from the family consisting of methyl ($CH_3$), ethyl ($C_2H_5$), and propyl ($C_3H_7$) groups, wherein each particular first structure of said first repeating base structure is crosslinked to a corresponding particular second structure of said second repeating base structure, via an ambiently biodegradable crosslinking structure, by means of at least two of: said carboxyl ion and said first and second carbonyl moieties, wherein said water is absorbed within said degradable polymer matrix, and wherein the gel formulation has a viscosity in a range of 500 cps to 50,000 cps.

According to still further features in the described preferred embodiments, the formulation further comprises at least one long-term fire retardant, preferably having a chemical anti-smoldering mechanism.

According to still further features in the described preferred embodiments, the crosslinking structure is attached to at least one of said first and second carbonyl moieties by means of a nitrogen atom.

According to still further features in the described preferred embodiments, the nitrogen atom is part of an amine group or part of an N—H group.

According to still further features in the described preferred embodiments, the cross-linking structure is attached to said first and second carbonyl moieties by means of a nitrogen atom.

According to still further features in the described preferred embodiments, the crosslinking structure is attached to at least one of said first and second carbonyl moieties by means of an oxygen atom.

According to still further features in the described preferred embodiments, the cross-linking structure attaching to the oxygen atom may include at least one of: a polysaccharide moiety (such as an acidic polysaccharide moiety), a tannin moiety, and a bivalent cation.

According to still further features in the described preferred embodiments, the concentration of said water-absorbent polymer matrix is at least 60%, at least 70%, at least 80%, at least 90%, or at least 95%, on an anhydrous basis.

According to still further features in the described preferred embodiments, the concentration of said water-absorbent polymer matrix is at most 30%, at most 20%, at most 15%, at most 10%, or at most 5%, on a hydrated basis.

According to still further features in the described preferred embodiments, the formulation further comprises an antibacterial agent.

According to still further features in the described preferred embodiments, the formulation is continuously disposed,—in terms of position—on an outdoor area having a length of at least 5 meters, at least 25 meters, at least 100 meters, or at least 250 meters, and a width of at least 5 meters, to form a physical barrier and a chemical firebreak against a fire such as a forest or brush fire.

According to still further features in the described preferred embodiments, the formulation is structured as a chemical firebreak on an outdoor area having a length of at least 5 meters, and a width within a range of 5 to 20 meters, and more typically, within a range of 5 to 15 meters.

According to still further features in the described preferred embodiments, the formulation is in a form of a firebreak at least partially disposed on a swath of vegetation having a length of at least 5 meters, at least 25 meters, at least 100 meters, or at least 250 meters, and a width within a range of 5 to 20 meters.

According to still further features in the described preferred embodiments, the chemical firebreak contains 0.5 liters to 50 liters of the formulation, per square meter of said firebreak.

According to still further features in the described preferred embodiments, the chemical firebreak contains 1.0 liter to 10 liters of the formulation, per square meter of said firebreak.

According to still further features in the described preferred embodiments, the formulation is positioned in a vicinity of a raging fire.

According to still further features in the described preferred embodiments, the formulation is disposed in or around a forest or brush.

According to still further features in the described preferred embodiments, the formulation further comprises a surfactant.

According to still further features in the described preferred embodiments, the formulation further comprises at least one vegetable oil.

According to yet another aspect of the present invention there is provided an ambiently degradable aqueous gel formulation comprising: (a) water; and (b) a water-absorbent, cross-linked polymer matrix having a plurality of connected base units, each base unit of said base units including: (i) a first base structure represented by:

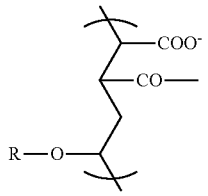

and having a carboxyl ion moiety (—COO—); (ii) a second base structure represented by:

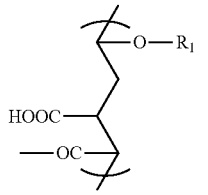

and having a carboxyl moiety (—COOH); both base structures having a carbonyl moiety (—CO—), wherein functional groups R and $R_1$ in said base structures are alkyl groups selected from the family consisting of methyl ($CH_3$), ethyl ($C_2H_5$), and propyl ($C_3H_7$) groups, and (iii) a third, intermediate base structure including at least one cross-linking moiety bridging between said carbonyl moiety on said first structure and said carbonyl moiety on said second structure, to form said base unit, wherein said polymer matrix is an ambiently degradable, cross-linked polymer matrix, and wherein said water is absorbed within said polymer matrix.

According to further features in the described preferred embodiments, the at least one crosslinking moiety includes at least one oxygen-bivalent cation (—O-$M^{++}$) moiety.

According to still further features in the described preferred embodiments, the at least one cross-linking moiety includes an oxygen-bivalent cation-oxygen (—O-$M^{++}$-O) moiety, an oxygen-bivalent cation-oxygen (—O-$M^{++}$-O) moiety, or at least two oxygen-bivalent cation (—O-$M^{++}$) moieties.

According to still further features in the described preferred embodiments, a polysaccharide (e.g., an acidic form) connects between said oxygen-bivalent cation moieties.

The bivalent cation is typically a bivalent metal cation, and according to still further features in the described preferred embodiments, may be selected from the group consisting of $Ca^{++}$ and $Mg^{++}$.

According to yet another aspect of the present invention there is provided a method of fighting a fire, the method comprising the steps of: (a) providing a aqueous gel formulation such as an SAP formulation; an ambiently degradable aqueous gel formulation; or an ambiently degradable aqueous gel formulation as described herein; and (b) applying said formulation in a vicinity of the fire, to fight the fire (at least partially extinguish, effect containment, etc.).

According to still further features in the described preferred embodiments, application is effected to produce a chemical firebreak including said aqueous gel formulation.

According to yet another aspect of the present invention there is provided a method of forestry firefighting, comprising the steps of: (a) providing, as a concentrate, the ambiently degradable aqueous gel formulation as described herein; and (b) diluting said concentrate formulation, prior to use, to produce a dilute product containing a working concentration of 2% to 6% solids by weight, in water.

According to still further features in the described preferred embodiments, the diluted product is applied by at least one of an aircraft, a terrestrial vehicular device and a manual device.

The present invention overcomes at least some of the disadvantages of prior art forest firefighting formulations by providing an extinguishing composition for forestry firefighting in the form of an aqueous suspension and/or emulsion, which is fully degradable and biocompatible with the forest biotope, and which retards the spread of forest fire, extinguishes the fire, and prevents re-ignition.

The present invention, in at least some embodiments, provides novel compositions comprising synthetic anhydride copolymers and natural products with polymeric and/or oligomeric character in an aqueous phase, which serve as cross-linking agents, and optionally also as dyeing agents or activators of degradation or biodegradation processes of the synthetic polymer.

The compositions of the present invention contain synthetic copolymers having structures which enable them to undergo a wide range of chemical transformations, providing water-swellable, polar, three-dimensional macromolecular configurations and which may be ambiently degraded, inter alia, by a mechanism including hydro-thermal decomposition that may be coupled with elimination of carbon dioxide and bio-assimilation.

The present invention, in at least some embodiments, provides compositions for fighting of forest fires, which rapidly extinguish burning of vegetation; which serve as a barrier to propagation of fire; and which prevent re-ignition for a long time after the water present in the composition has evaporated.

The present invention, in at least some embodiments, provides a versatile firefighting composition as a suspension or emulsion, which can be applied, for example, by aircraft, or by hand-held or vehicular terrestrial devices.

BRIEF DESCRIPTION OF THE FIGURES

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention.

In the Figures:

FIGS. 4A and 4B illustrate a fire-fighting test using a gel formulation of the present invention.

DESCRIPTION OF SOME EMBODIMENTS OF THE INVENTION

Figure 1A:
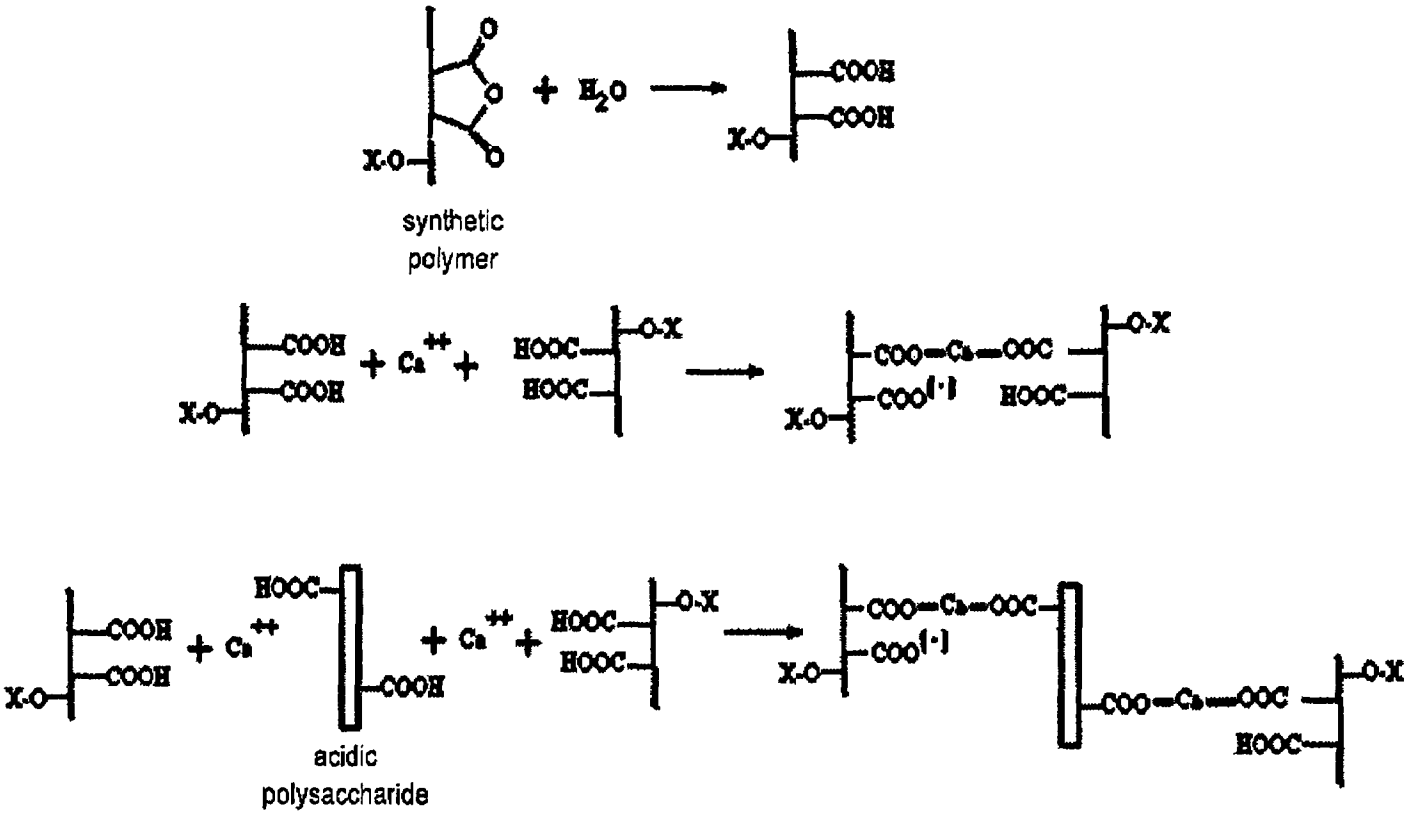
FIG. 1A is a schematic illustration of the interactions of the synthetic anhydride polymer with water and various bivalent cation crosslinking structures to produce gel formulations, in accordance with principles of various embodiments of the present invention.
Figure 1B:
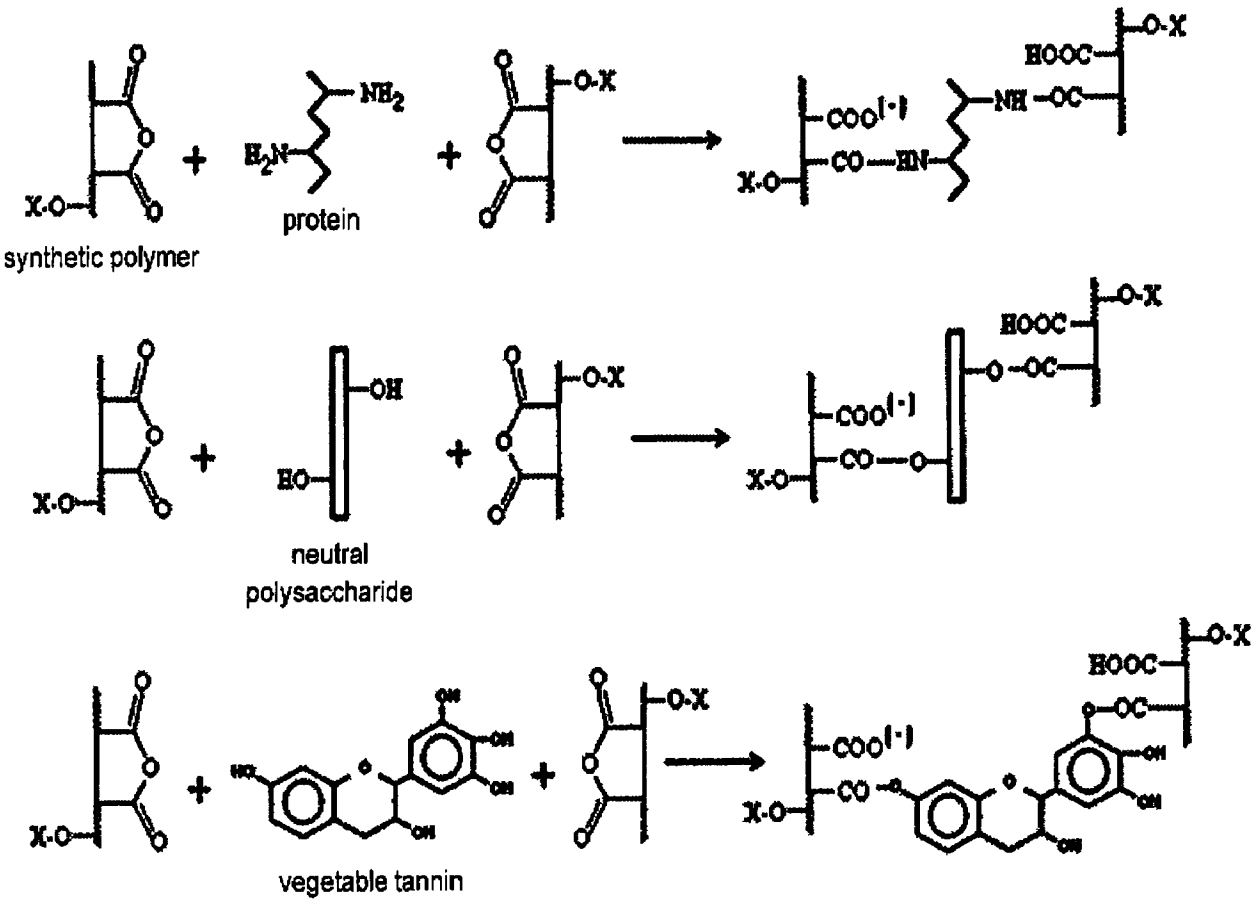
FIG. 1B is a schematic illustration of the interactions of the synthetic anhydride polymer with each of a protein, a polysaccharide, and a tannin, to produce gel formulations, in accordance with principles of various embodiments of the present invention.
Figure 1C:
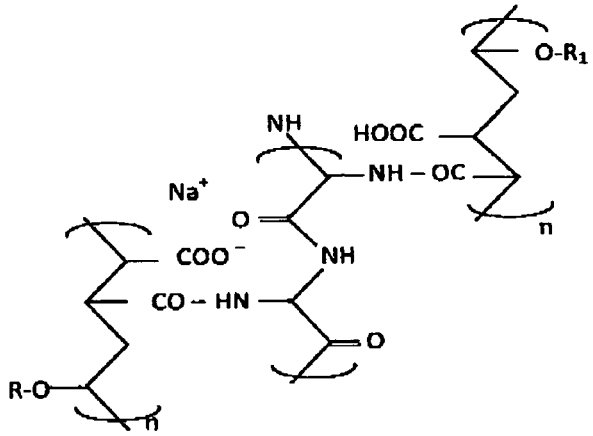
FIGS. 1C-1F are exemplary chemical representations of the inventive formulation having a crosslinked protein, a crosslinked polysaccharide, a crosslinked tannin, and a crosslinked bivalent metal cation.
Figure 1D:
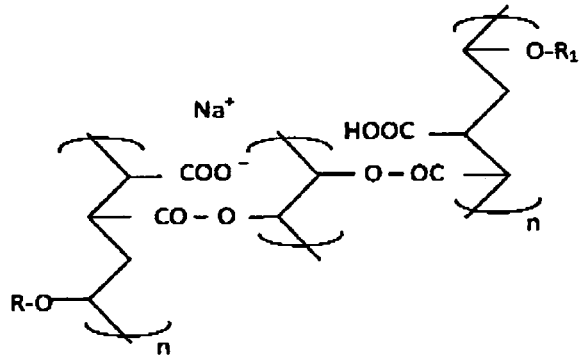
Figure 1E:
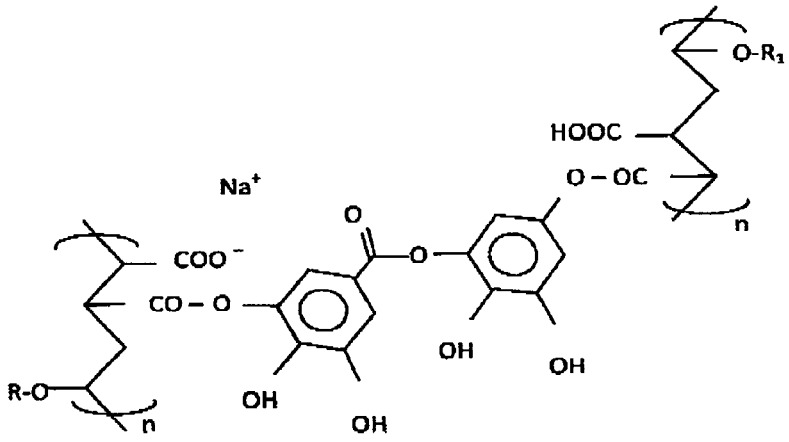
Figure 1F:
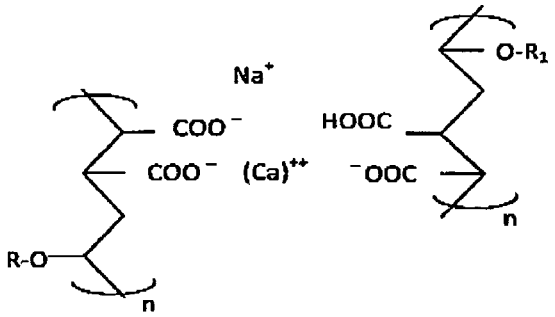

The invention, in at least some aspects, relates to ambiently degradable formulations and methods for fighting fires, particularly forest and brush fires.

We have recognized that the development of efficacious fire-fighting formulations for such uses—and for a chemical firebreak in particular—requires a plethora of physical, chemical, and biological properties. The formulation requires the super absorbance of water, and may further require the retention of that water over time. In natural, outdoor settings, the formulation needs to be ambiently degradable, otherwise the formulation might be a ecological blight (chemical, biological, aesthetic).

The degradation must be safe under ambient conditions, and, moreover, at extremely high temperatures as well. The formulation may not emit appreciable quantities of noxious degradation products, and may not pollute or negatively the environment, including groundwater.

For various important applications and uses, including the inventive use of the formulation in the physical form of a chemical firebreak—the degradation should preferably occur after 5 days. However, the degradation must generally be largely complete within 90-120 days. This timeframe places yet additional constraints on the various chemical and physical properties requisite for such fire-fighting applications.

According to some embodiments of the present invention, there is provided a biodegradable aqueous formulation comprising a synthetic anhydride copolymer; at least one crosslinking agent selected from the group consisting of a biopolymer and a vegetable tannin or mixtures thereof; and an inorganic alkaline compound.

The present invention, in at least some embodiments, provides aqueous formulations having high viscosity, which are useful in extinguishing fires. Such formulations are capable of adhesion to target surfaces, even at high temperatures, forming cohesive films with a particularly high water percentage and high stability, and are devoid of toxic effects on plant and animal matter, being ambiently degradable after use.

The firefighting formulations of the present invention utilize the cooling effects of water, and may further contain materials that provide long-term firefighting and anti-smoldering properties, long after the water content has evaporated.

The formulations of the present invention, in at least some embodiments, are stable even after prolonged storage, which can be prepared in a rapid and inexpensive manner by mixing with ordinary water, and may be applied using conventionally available fire extinguishing equipment.

The formulations of the present invention are particularly useful in fighting of forest fires.

According to some embodiments, the formulation of the present invention comprises a suspension or an emulsion, preferably having a water content of from about 30% to about 70% by weight, more preferably from about 35% to about 65% by weight, and most preferably from about 40% to about 60% by weight.

The formulation of the present invention, in at least some embodiments, exhibits some rheological character of non-Newtonian fluids. The formulation may be a pseudoplastic, with a characteristic viscosity preferably within the range of about 500 cps to about 50,000 cps, and more preferably, within the range of about 15,000 cps to about 45,000 cps.

Before explaining at least one embodiment in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

According to some embodiments, the synthetic anhydride copolymer of the formulation of the present invention is a water-insoluble copolymer comprising a first monomer (M1) and a second monomer (M2), wherein the structural formula of the polymer is:

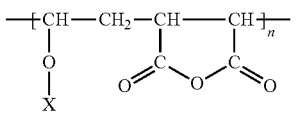

wherein

X=$CH_3$; $C_2H_5$; $C_3H_7$.

According to some embodiments, a ratio of M1:M2 in the synthetic anhydride copolymer may be about 50:50 mole percent.

According to some embodiments, M1 is selected from the group consisting of methyl vinyl ether; ethyl vinyl ether; propyl vinyl ether; isopropyl vinyl ether; vinyl propionate; and vinyl acetate.

According to some embodiments, M2 comprises maleic anhydride.

According to some preferred embodiments, the synthetic anhydride copolymer is an anhydride selected from the group consisting of poly(methyl vinyl ether-co-maleic anhydride) and poly (vinyl acetate-co-maleic anhydride).

According to some embodiments, the synthetic anhydride copolymer has a molecular weight of greater than about 50,000 Da, preferably greater than about 100,000 Da.

According to some embodiments, the concentration of synthetic anhydride copolymer in the formulation is from about 8% to about 24%, more preferably from about 10% to about 22%, and most preferably from about 12% to about 20% w/w of total formulation The synthetic polymers preferably have low thermal stability in aqueous medium, such that a continuous decrease in molecular weight occurs in aqueous medium at temperatures of greater than about 80° C., due to chain breaking and/or chemical modification [Ladaviere et al. (1999); Chitanu et al. (2005)]. The reaction mechanism that induces chain degradation includes the following phases: elimination of carbon dioxide and alcohol or acid, then Claisen rearrangement followed by transposition of an enol group with oxygen from the principal chain. A polyether is thereby formed, which may be further degraded by a mechanism such as that known in art for biodegradable synthetic polymers [Swift (2002); Amass et al. (1998)].

According to some embodiments, the biopolymer is a water-soluble biopolymer, such as a polysaccharide or a protein.

Representative polysaccharides include, without limitation, starch, dextran, pullulan, gellan gum, xylan, carrageenan, agar, locust bean gum, guar gum, gum arabic, pectin, alginate, xanthan, methylcellulose, ethylcellulose, hydroxyethylcellulose, hydroxypropylcellulose, ethylhydroxyethylcellulose, hydroxybutylmethylcellulose, hydroxyethylmethylcellulose, hydroxyethyl starch, hydroxypropyl starch, carboxymethylcellulose or carboxymethyl starch and the like.

Representative proteins include, without limitation, gelatin and collagen hydrolyzate and its derivatives, keratin hydrolyzate, casein, albumin, soybean protein and its derivatives. Especially preferred are the biopolymers guar gum, alginate and gelatin and derivatives thereof.

According to some preferred embodiments, the biopolymer is selected from the group consisting of guar gum, sodium alginate, and gelatin, and mixtures thereof. Optionally and preferably, the guar gum has a viscosity in solution of 1% concentration in the range of from about 500 to about 3,000 cps, more preferably in the range of from about 1,000 to about 2,000 cps. Optionally and preferably, the sodium alginate has a viscosity in solution of 1% concentration in the range of from about 500 to about 700 cps. Optionally and preferably, the gelatin has a Bloom Index of not less than about 20 and not higher than about 500; more preferably, the Bloom Index is between about 100 and about 300. Optionally and preferably, the gelatin has an isoelectric pH point of not less than about 3.5 and not higher than about 9.5, more preferably from about 4.5 to about 8.5.

According to some embodiments, the concentration of biopolymer in the formulation is from about 0.3% to about 3% w/w of total formulation, preferably from about 0.4% to about 2.7% w/w of total formulation, and more preferably from about 0.5% to 2.5% w/w of total formulation.

According to some embodiments, the vegetable tannin comprises an aromatic, acidic glucoside of polyphenols, such as are found in various plants and trees. Suitable tannins include both the gallotannins and the flavotannins (also referred to as catechol tannins). The tannin may be present in pure form, or may comprise a crude product obtained from a plant or tree source without purification.

According to a preferred embodiment, the vegetable tannin is a flavotannin, more preferably Quebracho tannin (3,5-dihydroxy-4,6-bis[(3,4,5-trihydroxybenzoyl)oxy]oxan-2-yl] methyl 3,4,5-trihydroxybenzoate).

In some embodiments, the vegetable tannin is present at a concentration in the range of from about 0.16% to about 1.6% w/w of total formulation, preferably from about 0.3% to about 1.5%, and more preferably from about 0.4% to about 1.3% w/w of total formulation.

According to some embodiments, the inorganic alkaline compound is selected from the group consisting of hydroxides; bicarbonates and carbonate monovalents of sodium, potassium, and ammonium, bivalents of calcium and magnesium, and trivalents of a metal or a transition metal, or mixtures thereof.

According to a preferred embodiment, the inorganic alkaline compound comprises one or more of sodium hydroxide, ammonium hydroxide, calcium hydroxide, calcium carbonate, aluminum hydroxide, iron hydroxide or mixtures thereof.

The formulation of the present invention may further include at least one of a vegetable oil; a surfactant; a long-term flame retardant; and an antibacterial compound.

The vegetable oil may be selected from the group consisting of flaxseed oil; hemp oil; castor oil; olive oil; rice oil; canola oil; maize oil; sunflower oil; palm oil; and soy bean oil, or mixtures thereof. In a preferred embodiment, the vegetable oil comprises one or more of flaxseed oil, canola oil and soy bean oil.

In some embodiments, the vegetable oil is present at a concentration in the range of from about 6% to about 16% w/w of total formulation, preferably from about 7% to about 15%, and more preferably from about 8% to about 14% w/w of total formulation.

In some embodiments, the surfactant is a biodegradable surfactant selected from a non-ionic surfactant (such as, for example, polyglyceryl-3 stearate; polyglyceryl-3 palmitate-polyglyceryl-2 laurate; polyglyceryl-5 laurate; glyceryl oleate; polyoxyethylene (10 mole) cetylether; polyoxyethylene monolaurate; polyoxyethylene vegetable oil; polyoxyethylene sorbitan monolaurate; polyoxyethylene sorbitol lanolin derivative; polyoxyethylene (12 mole) tridecyl ether; polyoxyethylene sorbitan monostearate; polyoxyethylene sorbitan monooleate; polyoxyethylene monostearate; polyoxyethylene (20 mole) stearyl ether; polyoxyethylene glycol monopalmitate; polyoxyethylene sorbitan monopalmitate; sodium oleate or potassium oleate) or an anionic surfactant (such as sodium stearoyl lactylate; glyceryl stearate citrate; sodium dialkyl sulfosuccinate; sulfated or sulfonated oils, including sulfated castor oil or sulfonated tallow).

According to a preferred embodiment, the surfactant comprises one or more of polyoxyethylene sorbitan monolaurate, sorbitanmonooleate and sulfated castor oil.

The surfactant may be present at a concentration in the range of from about 0.2% to about 2% w/w of total formulation, preferably from about 0.3% to about 1.8%, and more preferably from about 0.4% to about 1.6% w/w of the total formulation.

In other embodiments, the surfactant may be present at a concentration of about 5% to about 15% w/w of total formulation.

According to some embodiments, the antibacterial compound may include a preservative such as a paraben (including methyl paraben and propyl paraben), sodium benzoate, and triclosan (5-chloro-2-(2,4-dichlorophenoxy)phenol), or mixtures thereof.

Optionally and preferably, the antibacterial compound is present at a concentration of 0.05% w/w, at most, of the total formulation.

According to some embodiments, the biodegradable fire-fighting formulation of the present invention comprises a suspension or an emulsion. Optionally and preferably, the emulsion is an oil-in-water emulsion containing a solid and/or a gel. Optionally and preferably, the suspension may be a solid-liquid or gel-liquid aqueous suspension.

According to some embodiments, the biodegradable fire-fighting formulation is a thermodynamically compatible polymeric solution.

As used herein, the term "thermodynamically compatible polymeric solution" refers to a mixture of two or more polymers in an aqueous liquid phase, wherein intermolecular attractions occur between the polymers, with no separation phenomenon, during all stages of preparation, processing or use of the mixture [Gaylord (1975); Utracki (1989); Olabisi et al. (1979)].

According to some embodiments, the synthetic polymer is present in partially ionized form in the aqueous liquid, and the biopolymer has polar and ionizable functional groups, such that the mixture comprises two polyelectrolytes, which develop intermolecular interactions, resulting in partial or total intercoupling of the polymers with non-covalent bonds (hydrogen bonds and/or ionic bonds). Interactions between the two types of polymers cause an increase in the viscosity of the resultant solution, as compared to solutions comprising a single polymer.

According to some aspects of embodiments wherein the formulation is a solid-liquid aqueous suspension, the formulation is prepared by first preparing a suspension of synthetic anhydride copolymer in water; adding a suitable amount of an inorganic alkaline compound to bring the pH of the suspension to a value in the range of from about 5.5 to about 9.5, preferably from about 6 to about 9, and more preferably from about 6.5 to about 8.5. A biopolymer is then dissolved in water, optionally further comprising at least one additive selected from the group consisting of a vegetable tannin, an anionic surfactant and an antibacterial agent, or mixtures thereof. The biopolymer and/or the at least one additive may be dissolved in the water using any solubilization method known in the art. The suspension of synthetic anhydride copolymer is mixed with the solution of biopolymer and optional additives, using, for example, a planetary mixer, optionally at room temperature, to obtain the solid-liquid suspension. Optionally, a solid flame-retardant material is added to the solid-liquid suspension, to form a paste, and the suspension is optionally and preferably homogenized, for example by passing a number of times, such as two or three times, through a mixer, such as a three-roll mixer.

According to some embodiments, the formulation is a gel-liquid aqueous suspension, in which the gel particles optionally comprise one or more of three different structural types:

(1) gel particles comprising synthetic anhydride copolymer and vegetable tannins. Such particles are useful only for use in extinguishing fires in forest soil vegetation;

(2) gel particles comprising synthetic anhydride copolymer and biopolymer, having low adhesion to aerial forest vegetation, such as leaves. Such particles are optionally and preferably formed by cross-linking of the synthetic polymer with a cross-linker mixture comprising a protein and/or a polysaccharide; and (3) gel particles comprising synthetic anhydride copolymer and biopolymer, having high adhesion to aerial forest vegetation, such as leaves. Such particles are optionally and preferably formed by cross-linking of the synthetic anhydride polymer with a cross-linker mixture comprising a polysaccharide and/or a protein, vegetable tannin, and bivalent cation.

FIG. 1 illustrates the synthetic processes involved in the preparation of the three structural types of gel described above, which are characterized, on the one hand, by the reactive nature of the synthetic anhydride copolymer resulting in the formation of ester or amide type covalent bonds, and on the other hand by the anionic polyelectrolyte character, which favors the formation of ionic and hydrogen bonds with biopolymers and/or with vegetable tannins.

Preparation of the formulations of the present invention requires the use of processing methods which avoid hydrolysis reactions, in favor of acylation reactions, and which maintain the structural integrity of the biopolymer.

According to some aspects of embodiments wherein the formulation is a gel-liquid aqueous suspension, the formulation is prepared using either a 'sol-gel' method, in which a polymer solution is converted to an aqueous suspension comprising gel particles, or a 'solid-gel' method, in which a solid-liquid suspension is converted to an aqueous suspension comprising gel particles.

According to some embodiments, in the 'sol-gel' method a suspension of synthetic anhydride copolymer in water is first prepared, and a solution of monovalent inorganic compound added to the solution to convert the anhydride to a partially ionized carboxylate form which is soluble in water. In such embodiments, the cation content of the synthetic polymer corresponds to a degree of neutralization of free carboxylic groups of from about 10% to about 60% w/w, more preferably from about 15% to about 50%, and most preferably from about 20% to about 40% w/w. The suspension is preferably mixed at a temperature of less than about 50° C., and more preferably less than about 45° C., preferably for a period of from about 60 to about 90 minutes, until a transparent, viscous solution is obtained. A paste is prepared by reaction of an inorganic alkaline compound and an anionic surfactant, using any impastation method known in the art. Preferably the inorganic alkaline compound is present in an amount that provides a final concentration of bivalent cations in the range of from about 3% to about 30% w/w, more preferably from about 4% to about 25%, and most preferably from about 5% to about 20% w/w. Preferably, the anionic surfactant is present at a concentration of from about 0.5% to about 5% w/w of inorganic alkaline compound, and more preferably from about 1% to about 3% w/w of inorganic alkaline compound.

The paste is then optionally mixed with the viscous solution of synthetic polymer, preferably at room temperature, preferably for a time period of from about 10 minutes to about 15 minutes, until homogenization occurs. Optionally and preferably, a further solution of monovalent inorganic alkaline compound is then added to the homogenized suspension, to form a gel suspension, preferably at a concentration of at least about 30% w/w of total mixture, preferably such that the monovalent cation is sufficient to provide from about 30% to about 50% neutralization of the carboxylic functional group of the synthetic polymer, more preferably to provide from about 35% to about 45% neutralization, and most preferably from about 40% to about 60% neutralization. Preferably, the mixture is stirred for a time period in the range of from about 15 to about 45 minutes, more preferably from about 20 to about 40 minutes, preferably at a speed of greater than about 400 rpm, more preferably greater than about 600 rpm, and most preferably greater than about 1000 rpm, resulting in a gel suspension.

In some embodiments, the gel suspension is then mixed with a suspension of vegetable tannin, preferably at a concentration of from about 0.16% to about 1.6% w/w, more preferably from about 0.3% to about 1.5% w/w, and most preferably from about 0.4% to about 1.3% w/w; and flame-retardant, preferably at a concentration of from about 6% to about 16% w/w, more preferably from about 7% to about 15% w/w, and most preferably from about 8% to about 14% w/w of final formulation. Optionally, the gel suspension is further mixed with a long-term flame retardant.

According to some embodiments wherein the formulation comprises a gel-liquid aqueous suspension with biopolymer and high adhesion, the synthetic polymer suspension is optionally mixed with a solution of acidic polysaccharide prior to mixing with the paste of bivalent inorganic alkaline compound and surfactant.

According to some embodiments, the 'solid-gel' method comprises preparation of an aqueous solution of at least one biopolymer (such as neutral polysaccharide and/or aqueous solution of protein) and/or aqueous solution of vegetable tannin, by dissolving in a suitable volume of water to preferably give a final concentration of biopolymer or tannin of from about 5% to about 25% w/w of total solution, more preferably from about 7.5% to about 22.5% w/w, and most preferably from about 10% to about 20% w/w of total solution, using any solubilizing methods known in the art. A suspension of synthetic polymer in anhydride form is prepared, optionally at a concentration equal to half the desired final concentration in the formulation, by suspension of a quantity of macromolecule in powder form in a suitable volume of distilled water, preferably with mixing in a blender for about 5 minutes at a speed of from about 200 to about 300 rpm, optionally at room temperature. The solution of biopolymer or vegetable tannin is then added to the suspension of synthetic polymer, with mixing, preferably for a time period of from about 20 minutes to about 90 minutes, and more preferably from about 30 minutes to about 60 minutes, preferably at a speed of from about 100 rpm to about 200 rpm, to obtain a composite suspension. A monovalent inorganic alkaline compound is added to the composite solution, as a concentrated solution of at least 30%, preferably in a sufficient volume such that the amount of monovalent cation provides from about 50% to about 70% neutralization of carboxylic functional groups of the synthetic polymer, more preferably from about 55% to about 75% neutralization, and most preferably from about 60% to about 80% neutralization. Preferably, mixing is continued for a time period of from about 10 to about 40 minutes, more preferably from about 20 to about 30 minutes, preferably at a speed of greater than about 400 rpm, more preferably greater than about 600 rpm, and most preferably greater than about 1000 rpm, at room temperature, to obtain a gel suspension.

Optionally, at least one of a surfactant and a flame retardant is further added to the gel suspension, preferably in a planetary mixer. Preferably, the surfactant is present at a concentration of from about 0.2% to about 2% w/w, more preferably from about 0.3% to about 1.8% w/w, and most preferably from about 0.4% to about 1.6% w/w of final formulation. Preferably, the flame-retardant is present at a concentration of from about 6% to about 16% w/w of final formulation, more preferably from about 7% to about 15% w/w, and most preferably from about 8% to about 14% w/w.

Figure 2:
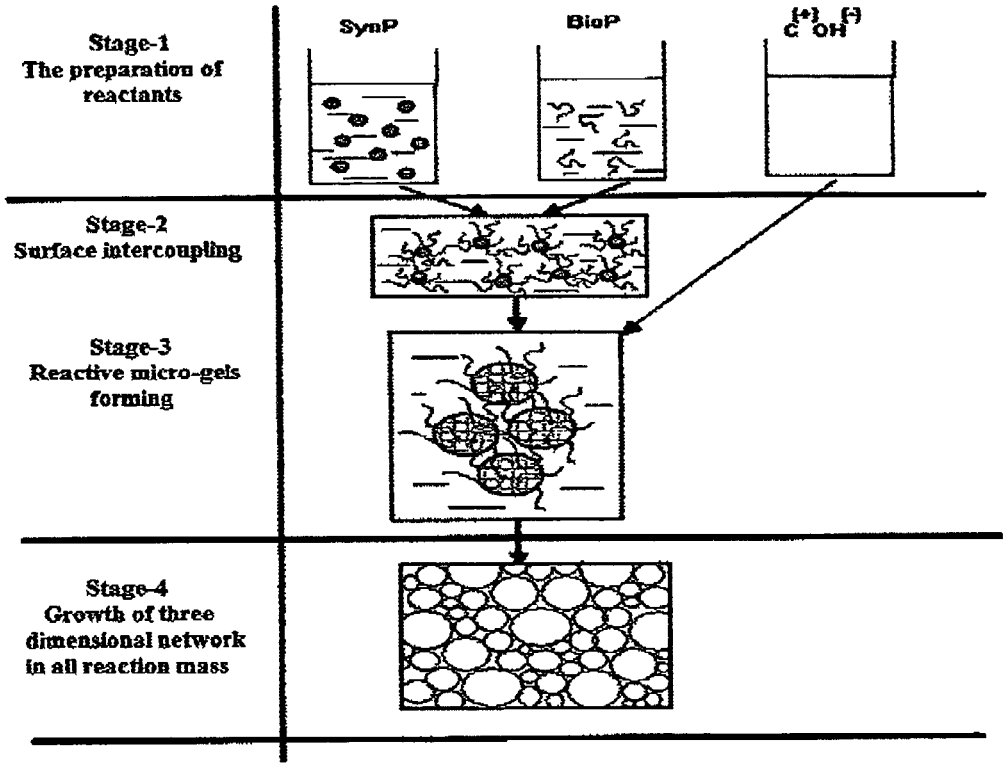
FIG. 2 represents a topochemistry model of the synthesis of a gel formulation of the present invention, by means of a 'solid-gel' method.
Figure 3:
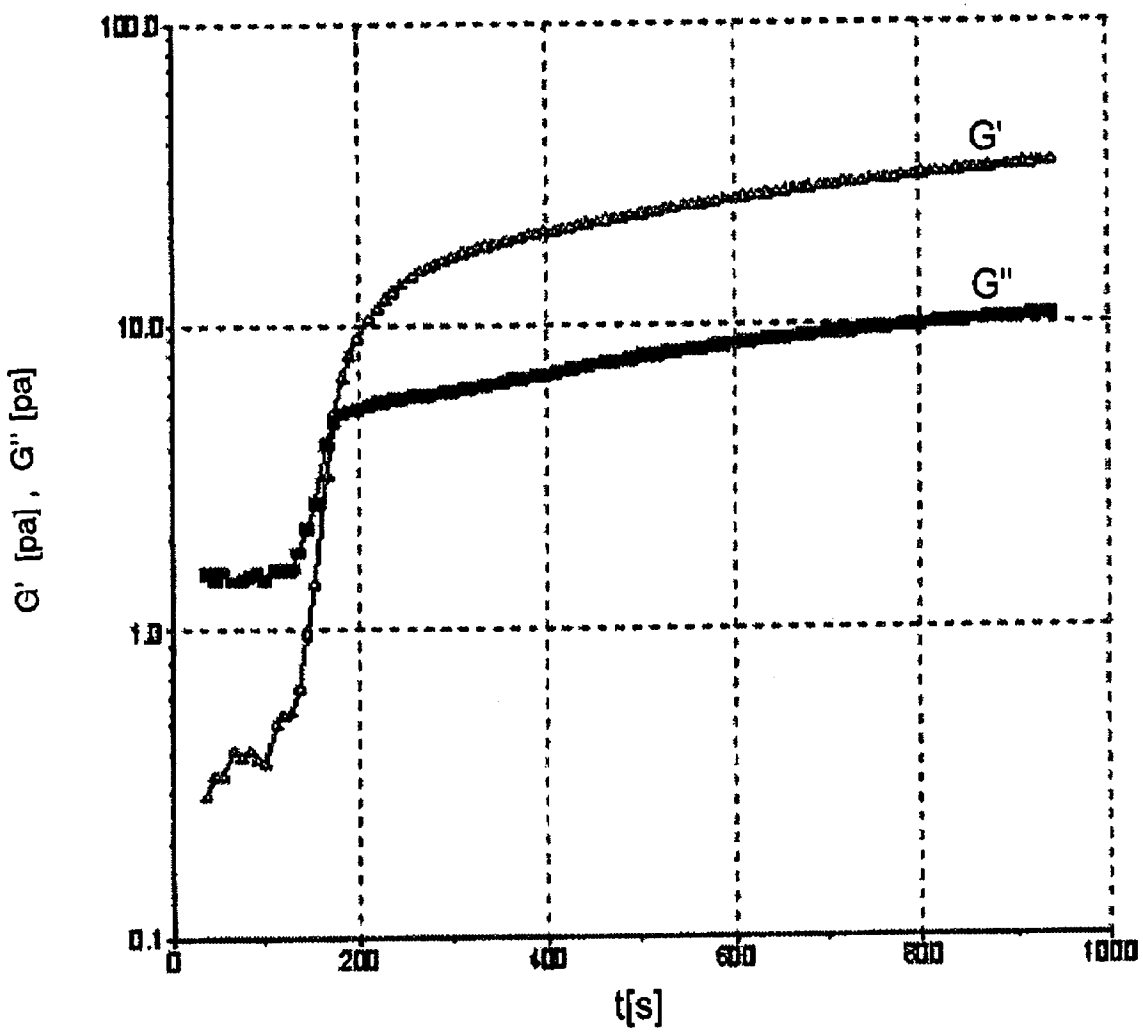
FIG. 3 is a graph showing the rheological evolution of the crosslinking reaction between the synthetic polymer and the biopolymer of the present invention, during the first 15 minutes after mixing, using the 'solid-gel' method.

In the model of the 'solid-gel' method of preparation shown in FIG. 2, the method is represented by 4 successive stages:

(1) Preparation of the reactants, comprising modification of the functionality of the reactive groups of the synthetic polymer and biopolymer from that of the dry state;

(2) Surface intercoupling, which occurs spontaneously upon mixing of the suspension of synthetic polymer with the solution of biopolymer or vegetable tannin. Initially, upon mixing, absorption of molecules of biopolymer onto the surface of particles of synthetic polymer occurs, with initial formation of ionic bonds. The biopolymer particles then tend to diffuse to the interior of the synthetic polymer particles. The solid-liquid interface of particles comprises reactive groups that react with free functional groups of the biopolymer, forming covalent polymer-polymer bonds, which prevent mass transfer of the biopolymer to the interior of the particles of synthetic polymer. Formation of covalent bonds stops upon penetration of the solid surface by the biopolymer, resulting in a drastic decrease of intermolecular reactions between synthetic polymer molecules, due to the effects of mechanical forces and repulsive forces generated by the thermodynamic incompatibility of the chain fragments of the two polymers;

(3) Formation of reactive microgels, which occurs spontaneously upon adding solution of inorganic monovalent alkaline compound. Within a few minutes of mixing, the viscosity of the reaction mass increases drastically (by a factor of from about 100 to about 1000 that of the product of stage 2), as shown in FIG. 3. During this time, the rapid swelling of polymer particles can be visualized macroscopically, as individual particles merge and the optical properties of the reaction system are modified. The reaction mass becomes granular, with no liquid phase. Addition of the base causes activation of the biopolymer, which functions as transfer agent of cations to the reactive functional groups of the synthetic polymer, thereby intensifying acylation and hydrolysis reactions; and (4) Growth of a three-dimensional network, beginning from formation of microgel and forming a continuous mass of gel. The three-dimensional network comprises small pieces of gel, which are transparent and elastic, with remarkable mechanical resistance to the sheer stress generated by the mixing device.

In some embodiments, wherein the formulation is an oil-in-water emulsion with a solid and/or gel content, the formulation is prepared as a solid-liquid aqueous suspension or gel-liquid suspension, by mixing emulsions of vegetable oil, water and surfactant, which have been prepared by any method of preparation known in the art.

The formulation of the present invention is used in fighting of forest fires in dilute form, wherein the water content is from about 94% to about 98%, by simple mixing with water (such as tap water, river water etc).

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

EXAMPLES

Example 1

Preparation of a Solid-Liquid Suspension 300 ml demineralized water and 160 g of synthetic polymer poly (methyl vinyl ether-co-maleic anhydride) with 200,000 Da average molecular mass, as white powder with specific gravity of 1.018 (GANTREZ AN 119™ from International Specialty Products (ISP)) were placed in a laboratory planetary mixer. After 15 minutes of mixing at room temperature, 150 g of ammonium hydroxide solution was added, and mixed for a further 60 minutes. 610 g of transparent, viscous solution, with a pH=6.85 was obtained.

200 ml of a solution comprising 6 g vegetable tannin Quebracho (UNITAN CROWN ATO, from UNITAN, Argentina) in demineralized water were placed in a laboratory blender with capacity of 1 Liter (KENNEDY Model KN-310), with 4 g of sulphated castor oil (Actrasol C75™, density 8.6 lb/gal, total Alkalinity 21 mg KOH/g, free fatty acid 4% and SO3 content 3.5%, from CLIMAX Corp.) in which was suspended 16 g guar gum (from SIGMA catalog number G4129-250G) and 0.1 g triclosan from Fluka™. The resultant suspension was mixed at room temperature, at a speed of 600 rpm, for 15 minutes, to obtain 226 g of semi-transparent brown-reddish solution.

The tannin solution was added to the synthetic polymer solution from the planetary mixer and mixed for a further 20 minutes at room temperature. 100 g of an aluminum phosphate salt (TexFRon™ AG of 5% concentration by weight from ICL-IP, Beer Sheva Israel), was added, and homogenized for 10 minutes. The resultant paste was passed three times through a laboratory three roll mixer. 920 g of solid-liquid suspension, of 22% concentration, in the form of a homogenous paste with light brown-reddish color was obtained, with a viscosity of 11,230 cps evaluated with a Brookfield™ type digital viscometer model DV-79, spindle F, rotary speed 75 rpm, from MRC Laboratory Equipment Manufacturer, Israel.

Example 2

Preparation of Gel-Liquid Water Suspension by 'Solid-Gel' Method 250 ml demineralized water and 100 g synthetic polymer GANTREZ AN 119™ were placed in a laboratory blender with a capacity of 2 Liter, as for Example 1, and mixed at room temperature, at a speed of 200 rpm for 5 minutes, to obtain a homogenous suspension. To the suspension was added 50 ml gelatin solution (with Bloom index of 200 and IP=7.2 from SIGMA catalog no. 27, 161-6) of 16% by weight concentration, prepared by simple dissolution of the biopolymer in water at a temperature of 50° C. using a magnetic stirrer. After 20 minutes of homogenization, under slow mixing conditions, 100 ml of NaOH solution of 30% by weight concentration was added, and the stirrer speed increased to 800 rpm for a further 30 minutes at room temperature. 500 g of polymeric material with a pronounced gel character was obtained.

The polymeric material was then mixed with 150 g of flame retardant TexFRon AG™ and 8 g of sulphated castor oil (Actrasol C75) in a planetary mixer, for 20 minutes, at room temperature. 658 g of gel-liquid water suspension of 27% concentration (w/w), with viscosity of 26,320 cps, was obtained.

The chemical process of cross-linking of the synthetic polymer by the biopolymer through the "solid-gel" method was demonstrated by a rheological experiment wherein a sample of 8 g was taken from the reaction mass following addition of sodium hydroxide solution, after 2 minutes of mixing in the blender. The sample was immediately placed in the a rheometer measuring device (Rheometer RheoStress 1 from ThermoHaake™, Germany, with cup cylinder sensor Z20DIN and Star Sensor FL16, Radius Ri=8.0 mm and length L=8.8 mm) and the test begun, consisting of Oscillation Time Sweep for a period of 15 minutes. Changes in rheological values of storage modulus (G') and loss modulus (G") of the sample with time are presented in FIG. 3.

Data from FIG. 3 show that the initial reaction mass is a suspension, which has a fluid character which is transformed with time to a gel type, since the ratio G"/G' attains a value of less than 1 after approximately 5 minutes, and storage modulus remains approximately constant during the time interval of from about 5 to about 15 minutes of testing.

Example 3

Preparation of an Oil-in-Water Emulsion Comprising Gel Particles

A gel-liquid was first prepared as for Example 2, using a mixture of 10 g of alginate and 4 g of vegetable tannin (Quebracho) instead of gelatin, and 18 g of $Na_2CO_3$ instead of NaOH. 508 g of polymeric material in gel form with light brown-reddish color was obtained, to which was added in a blender 45 g of Canola oil and 8 g of sulfonated castor oil as surfactant, with mixing at room temperature for 30 minutes, at a speed of 1000 rpm. The resultant emulsion was transferred to a laboratory blender and mixed with 80 g of flame retardant. 640 g of emulsion with a viscosity of 9460 cps was obtained.

Example 4

Fire-Fighting Test

A layer of hay with a thickness of 10 cm was arranged in each of 3 metallic trays with dimension of 40×30 cm. Into the middle of each tray was poured a uniform strip of 6 cm width of 24 g of one of the extinguisher formulations prepared in Examples 1-3, at 2% concentration. The hay was set alight by applying a match at one end, and a chronometer started. The experiment was performed out of doors, in strong windy weather. When the fire reached the strip of hay pre-treated with diluted extinguisher formulation, the fire stopped, as seen in FIG. 4. The time from the fire being started until it was extinguished was measured.

The experimental results of the fire fighting test are presented in Table 1. The experimental data show the extinguishing action of the formulations of the present invention. The effectiveness of the extinguishing effect of the formulation depends on the chemical formulation of the mixture and its rheological character.

TABLE 1

| Sample | Viscosity of diluted extinguisher formulation (cps) | Extinguishing period (sec) |
|---|---|---|
| Example 1 | 136 | 60 |
| Example 2 | 183 | 90 |
| Example 3 | 75 | 45 |

Unless otherwise defined, all technical and scientific terms used herein have the same meaning as commonly understood by one of ordinary skill in the art to which the invention pertains. In case of conflict, the specification, including definitions, will control.

In addition, the materials, methods, and examples are illustrative only and not intended to be limiting.

As used herein, the term "ambiently degradable", with respect, inter alia, to an aqueous gel formulation, various base structures thereof, and the like, refers to a formulation that undergoes significant degradation under ambient conditions, in a timeframe that is suitable for firefighting in forests, brush, and the like. In quantitative terms, degradation is evaluated on the basis of percent weight loss after a given length of time. The degradation test procedure for evaluating the extent of degradation over time is as follows:

Mix 5% concentration by weight of test polymer in a standard municipal compost. Incubate at 37° C. Measure weight loss after 5 days and after 30 days. Standard SAP (sodium polyacrylate) shows less than a 1% weight loss after 5 days and less than a 1% weight loss after 30 days. Poly(maleic anhydride-methyl vinyl ether copolymer), which may exhibit excellent degradation performance, shows at least a 5% weight loss after 5 days and at least a 20% weight loss after 30 days.

As used herein, the term "ambiently degradable" refers to a substance having ample degradation performance in this degradation test procedure, exhibiting a weight loss of at least 2.5% after 5 days or (preferably and) a weight loss of at least 5% after 30 days.

Long term fire retardants actively retard flaming after all the water from the formulation has evaporated. Flame retardation is achieved by either a gas phase mechanism, or a solid phase mechanism. In the gas phase mechanism, upon heating, the flame retardant emits free radicals and incombustible gases into the flaming zone that, in turn, suppress the fuel oxidation cycle and retard flaming. In the solid phase mechanism, the flame retardant either emits a strong acid or other reactant that chemically decomposes the fuel into inert components such as char or the flame retardant absorbs heat, thus reducing the temperature of the fuel and retarding emission of flammable gases.

As used herein, the term "chemical anti-smoldering mechanism" is meant to refer to a solid phase mechanism in which the flame retardant emits a substance that chemically decomposes the fuel into inert components.

Smoldering is a low temperature combustion process typical in cellulosic fuels such as wood and paper. An anti-smoldering agent reduces smoldering by emitting a strong acid within the smoldering temperature range and thus chemically decomposes the smoldering ember into inert components such as char.

As used herein the term "repeating", "repeating sequence", and the like, with respect to a polymer, monomer, or polymer base structure, refers to a repeating sequence of a specific base structure, or to a repeating sequence of similar base structures. By way of example, an anhydride copolymer in which the n repeating units have different appended functional groups, such as methyl ($CH_3$), ethyl ($C_2H_5$), and propyl ($C_3H_7$) groups.

As used herein, viscosity values refer to viscosity values obtained using a Brookfield type digital viscometer viscometer, using conventional, appropriate preparation and evaluation procedures and methodologies.

As used herein the term "practically insoluble" and the like refers to a material whose solubility in water at 20° C. or 25° C. is—at most—100 ppm (after United States Pharmacopeia USP definitions). More typically, the solubility of such practically insoluble materials is less than 30 ppm, less than 10 ppm, or less than 5 ppm.

As used herein the term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

As used herein, the terms "comprising", "including", "having" and grammatical variants thereof are to be taken as specifying the stated features, integers, steps or components but do not preclude the addition of one or more additional features, integers, steps, components or groups thereof. These terms encompass the terms "consisting of" and "consisting essentially of".

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and scope of the appended claims.

Citation or identification of any reference in this application shall not be construed as an admission that such reference is available as prior art to the invention.

Section headings are used herein to ease understanding of the specification and should not be construed as necessarily limiting.

REFERENCES

Amass W., Amass A., Tighe B. [1998], "A Review of Biodegradable Polymers: Uses, Current Developments in the Synthesis and Characterization of Biodegradable Polyesters, Blends of Biodegradable Polymers and Recent Advances in Biodegradation Studies" *Polymer International* Vol. 47: 89-144.

Chitanu G. C., Rinaudo M., Milas M., Carpov A. [2005], "Thermal Stability of Maleic Acid-Vinyl Acetate Copolymer in Aqueous Solution: Size Exclusion Chromatography Analysis", International Journal of Polymer Analysis and Characterization, Vol. 10: 123-139.

Gaylord, N. G [1975], "Copolymers, Polyblends and Composites", in *Adv. Chem.* 142, 76.

Hardy C. E. [1977], "Chemicals for Forest Fire Fighting", 3rd edition, Boston, Ladaviere C., Delair T., Domard A., Pichot C., Mandrand B. [1999] "Studies of the thermal stability of maleic anhydride co-polymers in aqueous solution", *Polymer Degradation and Stability* Vol. 65: 231-241.

Olabisi O., Robson L. M., Shaw M. T. [1979], "Polymer-Polymer Miscibility, Academic Press, New York.

Swift G. [2002], "Biodegradation of Synthetic Water Soluble Polymers", In "*Biopolymers*" Vol. 9, S. Matsumura and A. Steinbuchel (eds.) Wiley—VCH Verlag GmbH, Weinheim, Germany.

Utracki L. A. [1989], "Polymer Alloys and Blends", Hanser Publishers, Munich.

What is claimed is:

1. An ambiently degradable aqueous gel formulation comprising:

(a) water; and (b) a water-absorbent, ambiently degradable co-polymer having (i) a first repeating, ambiently degradable base structure being formed of n first building blocks, each first building block having a carboxyl ion moiety (—$COO^-$) and a first carbonyl moiety, (—CO—) the first base structure being represented by:

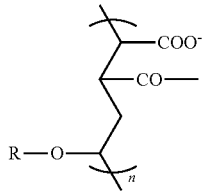

(ii) a second repeating, ambiently degradable base structure being formed of n second building blocks, each second building block having a carboxyl moiety (—COOH) and a second carbonyl moiety (—CO—), the second base structure being represented by:

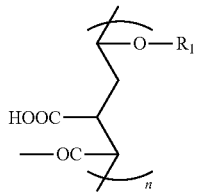

wherein functional groups R and $R_1$ in said base structures are alkyl groups independently selected at each instance from the family consisting of methyl ($CH_3$), ethyl ($C_2H_5$), and propyl ($C_3H_7$) groups, the value of n in said first and second repeating base structures being selected such that the molecular weight of said copolymer is than 50 000 Daltons(Da);

wherein each of the n building blocks of said first repeating base structure is crosslinked to a corresponding second building block of said second repeating base structure, via an ambiently biodegradable crosslinking structure, by means of at least two of:

said carboxyl ion and said first and second carbonyl moieties, wherein said water is absorbed within said degradable copolymer, and wherein the gel formulation has a viscosity in a range of 500 cps to 50,000 cps.

2. The formulation of claim 1, wherein said crosslinking structure is attached to at least one of said first and second carbonyl moieties by means of a nitrogen atom.

3. The formulation of claim 2, wherein said nitrogen atom is part of an amine group.

4. The formulation of claim 1, wherein said crosslinking structure is attached to at least one of said first and second carbonyl moieties by means of an oxygen atom.

5. The formulation of claim 1, disposed on an outdoor area having a length of at least 5 meters, and a width of at least 5 meters.

6. The formulation of claim 1, further comprising a surfactant.

7. The formulation of claim 1, further comprising at least one long-term fire retardant.

8. The formulation of claim 7, said long-term fire retardant having a chemical anti-smoldering mechanism.

9. The formulation of claim 1, wherein said nitrogen atom is part of an N—H group.

10. The formulation of claim 1, wherein said cross-linking structure is attached to said first and second carbonyl moieties by means of a nitrogen atom.

11. The formulation of claim 4, wherein said cross-linking structure includes a moiety selected from the group consisting of a polysaccharide moiety and a tannin moiety.

12. The formulation of claim 4, wherein said cross-linking structure includes a bivalent cation.

13. The formulation of claim 1, wherein the concentration of said water-absorbent polymer in said formulation is at least 60%, on an anhydrous basis.

14. The formulation of claim 1, wherein the concentration of said water-absorbent polymer in said formulation is at most 30%, on a hydrated basis.

15. The formulation of claim 1, disposed as a chemical firebreak on an outdoor area having a length of at least 5 meters, and a width within a range of 5 to 20 meters.

16. The formulation of claim 1, at least partially disposed as a chemical firebreak on a swath of vegetation having a length of at least 5 meters, and a width within a range of 5 to 20 meters, said chemical firebreak containing 0.5 liters to 50 liters of the formulation, per square meter of said firebreak.

17. The formulation of claim 1, disposed in a vicinity of a raging fire.

18. The formulation claim 1, disposed in or around a forest or brush.

19. The formulation of claim 7, said at least one long-term flame retardant being selected from the group consisting of brominated compounds, phosphorous compounds, organophosphorous compounds, chlorinated compounds, tin compounds, alumina hydrates, metal polyphosphates, borates and antimony oxides.

20. The formulation of claim 7, said at least one long-term flame retardant being at most practically insoluble in water, at 20° C.

21. The formulation of claim 1, the value of n in said first and second repeating structures being selected such that said molecular weight is greater than 100,000 Daltons (Da).

22. The formulation of claim 1, the value of n said first and second repeating structures being selected such that said molecular weight is about 200,000 Daltons (Da).

* * * * *